US005593368A

United States Patent [19]

Checketts

[11] Patent Number: 5,593,368

[45] Date of Patent: Jan. 14, 1997

[54] DEVICE FOR REDUCING IMPACT AND LATERAL MOVEMENT ON RESILIENT SURFACES

[76] Inventor: Stanley J. Checketts, P.O. Box 55, Providence, Utah 84332

[21] Appl. No.: 101,654

[22] Filed: Aug. 4, 1993

Related U.S. Application Data

[63] Continuation-in-part of Ser. No. 12,257, Feb. 1, 1993, abandoned.

[51] Int. Cl.[6] ..... A63B 5/11

[52] U.S. Cl. ..... 482/27; 482/23; 482/123; 482/130

[58] Field of Search ..... 482/23, 27, 43, 482/69, 121, 124, 129, 130

[56] References Cited

U.S. PATENT DOCUMENTS 4,431,184 2/1984 Lew et al. ..... 482/43
4,968,028 11/1990 Wehrell ..... 482/43
4,976,623 12/1990 Owsley ..... 482/43
5,221,241 6/1993 Bare, II ..... 482/43

*Primary Examiner*—Lynne A. Reichard
*Attorney, Agent, or Firm*—Thompson E. Fehr

[57] ABSTRACT

Two resilient bands attached to anchors slidably mounted on two vertical support columns that are placed on opposite sides of a horizontal resilient surface, usually a trampoline. The resilient bands are connected to a participant and exert upon the participant a lateral restraining force which is proportional to the distance that the participant moves laterally from the center of the horizontal resilient surface. The anchors can be, in different embodiments, raised manually, with a motor, remotely, or automatically. Therefore, the resilient bands also exert upon the participant a vertical restraining force that is proportional to the distance the participant has moved vertically from the horizontal resilient surface.

2 Claims, 7 Drawing Sheets

DEVICE FOR REDUCING IMPACT AND LATERAL MOVEMENT ON RESILIENT SURFACES

CROSS-REFERENCE TO RELATED APPLICATION

This is a continuation-in-part of U.S. application Ser. No. 08/012,257, filed on Feb. 1, 1993 now abandoned.

BACKGROUND OF THE INVENTION

1. Field of the Invention

This invention relates to safety equipment primarily for use with a trampoline.

2. Description of the Related Art

Unfortunately, devices employing resilient surfaces, such as trampolines, which are intended to provide recreational pleasure occasionally produce moderate to catastrophic injuries.

The principal method for minimizing such injuries has been placing padding on non-resilient surfaces of the trampoline. But extremely serious injuries can be caused even when the impact of the participant is with the resilient surface.

In training situations, a rope sometimes is attached to the participant, passed over an elevated pulley, and held by the participant's instructor. But this technique prevents undesired impacts only when the instructor secures the rope and then, itself, creates an unwelcome impact because of the lack of resilience in the rope.

SUMMARY OF THE INVENTION

The instant invention, however, allows a participant virtually unrestricted movement laterally near the center of the resilient surface, exerts a lateral restraining force which is proportional to the distance that the participant moves laterally from the center of the resilient surface, and exerts a force to reduce vertical impacts that is proportional to the vertical distance which the participant has traveled above the resilient surface. Moreover, the basic function of the instant invention requires no intervention by a second party.

The present invention involves allowing the participant virtually unrestricted lateral movement near the center of a horizontal resilient surface; exerting on the participant a lateral restraining force which is proportional to the distance that the participant moves laterally from the center of the horizontal resilient surface; allowing the participant virtually unrestricted vertical movement in the proximity of a selected elevation above the horizontal resilient surface, which elevation may be raised or lowered; and exerting on the participant a vertical restraining force which is proportional to the distance that the participant has moved vertically from the horizontal resilient surface. Thus, the higher a participant bounces—and the force of impact would without the instant invention increase as the height of the bounce increases—the greater will be the vertical restraining force and, consequently, the cushioning effect.

DESCRIPTION OF THE PREFERRED EMBODIMENT

Physically, the preceding can be accomplished in the manner explained below.

Figure 2:
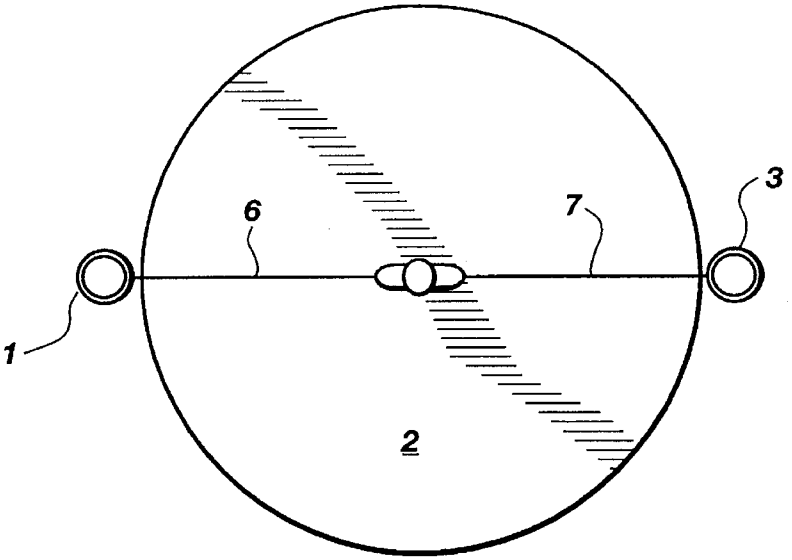
FIG. 2 presents an overhead view of the embodiment of FIG. 1.
Figure 1:
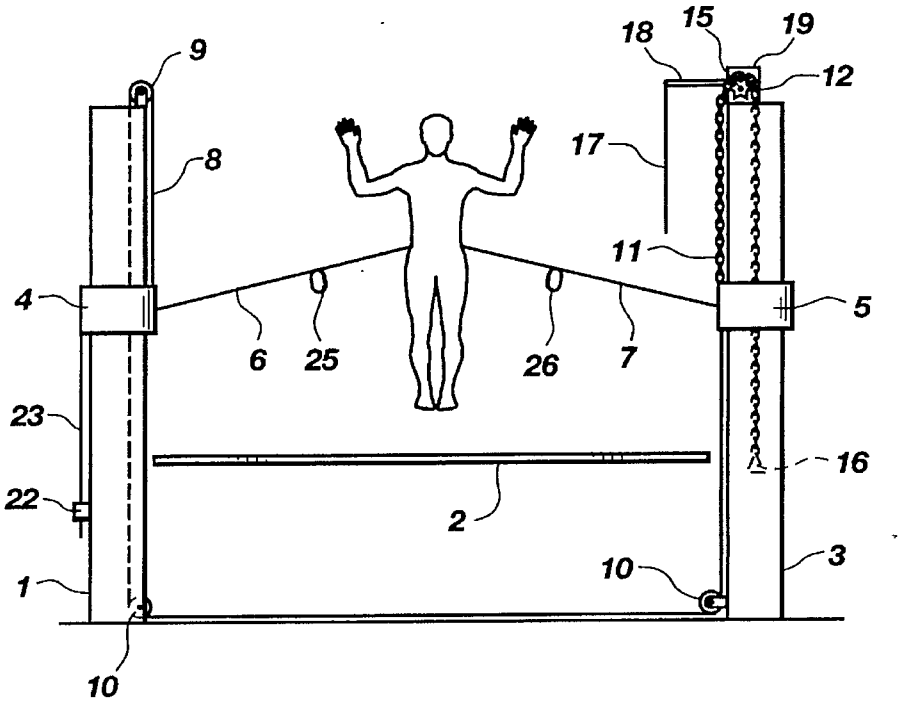
FIG. 1 shows a lateral view of the embodiment of the device for reducing impact and lateral movement on a horizontal resilient surface in which a weight is used to raise the anchors automatically.

As shown by FIG. 1 and FIG. 2, in the preferred embodiment, a first vertical support column (1) is placed on one side of a horizontal resilient surface (2), usually a trampoline; and a second vertical support column (3) is placed on the opposite side of the horizontal resilient surface (2). On the first vertical support column (1) is slidably mounted a first anchor (4), and on the second vertical support column is slidably mounted a second anchor (5). A first resilient band (6) is attached to the first anchor (4) and is to be connected to the participant, preferably near the participant's center of gravity, as also is a second resilient band (7) attached to the second anchor (5) and to be connected to the participant, preferably near the participant's center of gravity, so that as the participant moves laterally from the center of the horizontal resilient surface (2), the participant is subjected to a lateral restraining force on the participant which is proportional to the distance that the participant has moved laterally from the center of the horizontal resilient surface (2).

Figure 3:
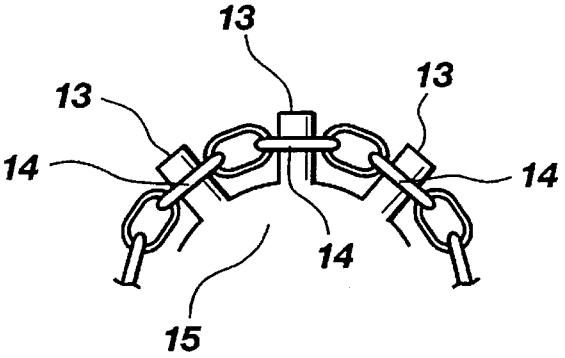
FIG. 3 is a detailed view of the interaction between the teeth of the toothed wheel and the likes of the chain of the embodiment from FIG. 1.

A cable (8) is connected to the first anchor (4). The cable (8) runs over an upper pulley (9) and around one or more lower pulleys (10) before reaching the second anchor (5), to which the cable (8) is connected. Also connected to the second anchor (5) is a chain (11) that continues to the top of the second vertical support column (3) and passes around a toothed wheel (12) mounted on a ratcheted axle (15) that is connected to the second vertical support column (3), the teeth (13) of which, as shown in FIG. 3, fit into the links (14) of the chain (11). The chain (11) then continues downward and is attached to a weight (16). Thus, when the participant bounces upward, the participant pulls the first resilient band (6) and the second resilient band (7) upward. Consequently, the first resilient band (6) pulls the first anchor (4) upward; and the second resilient band (7) pulls the second anchor (5) upward.

The ratcheted axle (15) prevents the toothed wheel (12) from rotating in such a direction that the chain (11) can permit the second anchor (5) and, consequently, the first anchor (4) to descend. Therefore, as the participant bounces higher, the first anchor (4) and the second anchor (5) will be pulled to a higher elevation from which they cannot descend. As the participant approaches the horizontal resilient surface (2) from a higher bounce, the first resilient band (6) and the second resilient band (7) will be stretched more, producing a vertical restraining force which is proportional to the distance that the participant has moved vertically from the horizontal resilient surface (2).

Figure 4:
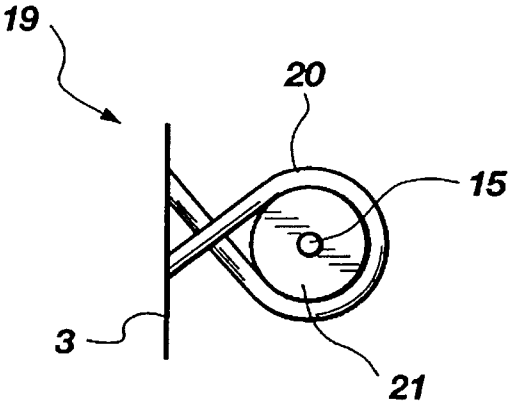
FIG. 4 illustrates the rope brake from the embodiment of FIG. 1.

When the participant desires to lower the first anchor (4) and the second anchor (5), the participant simply pulls a first, line (17) that is suspended from a lever (18) that releases the ratcheted axle (15) so that the toothed wheel (12) can rotate in such a direction that the chain (11) can permit the second anchor (5) and, consequently, the first anchor (4) to descend. A descent braking means, preferably as depicted in FIG. 4, a rope brake (19), i.e., a rope (20) that can be adjusted to different degrees of tension, that is secured to the second vertical support column (3), and that is wound around a disc (21) which is attached to the ratcheted axle (15), is attached to the ratcheted axle to control the rate at which the ratcheted axle rotates while the first anchor and the second anchor descend.

If the participant desires to limit the height to which the first anchor (4) and the second anchor (5) can be pulled, the participant can—before climbing onto the horizontal resilient surface (2)—secure a clamp (22), which is attached to the first vertical support column (1), to the appropriate point (for the maximum desired elevation above the horizontal resilient surface) on a second line (23), which is suspended from the first anchor (4).

Figure 5:
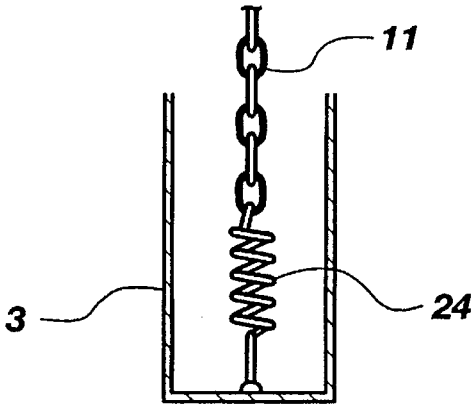
FIG. 5 depicts a spring replacing the weight in the embodiment of FIG. 1.

As illustrated in FIG. 5, the weight (16) could be replaced with a spring (24) connected both to the chain (1) and the second vertical column (3).

In the preferred embodiment, a first exercise grip (25) is attached to the first resilient band (6); and a second exercise grip (26) is attached to the second resilient band (7) so that the participant can pull on the first resilient band (6) and the second resilient band (7) to exercise the participant's upper extremities.

Figure 6:
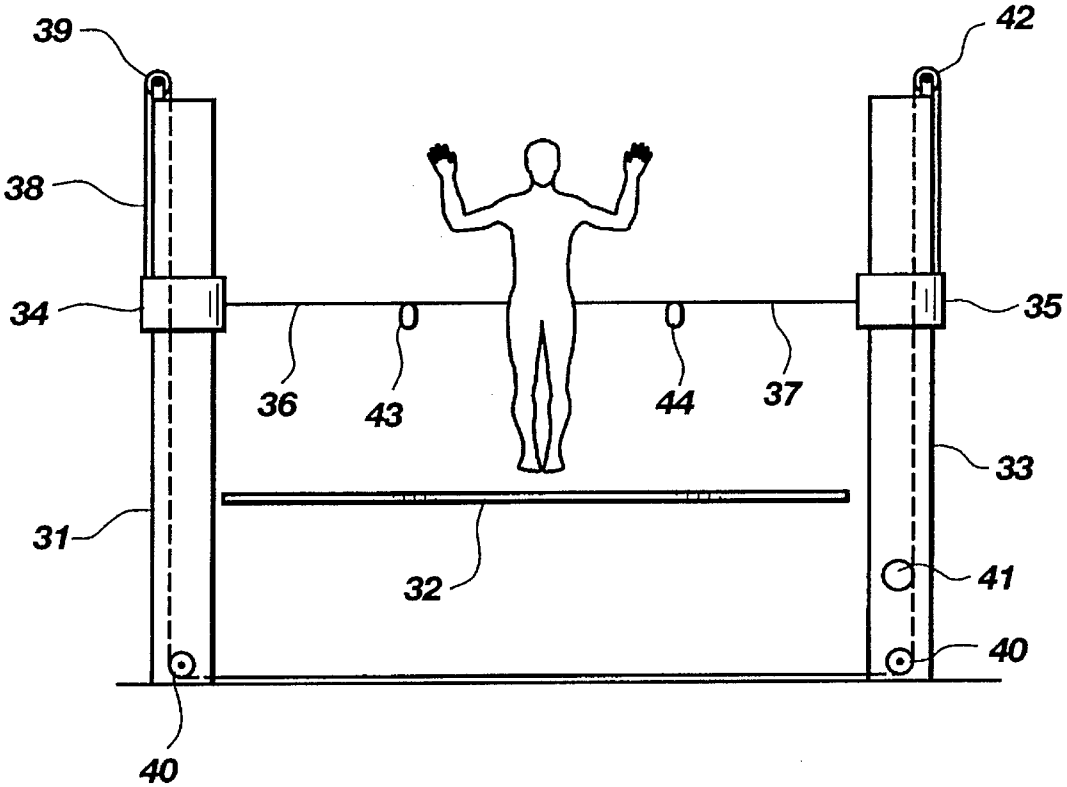
FIG. 6 displays an embodiment in which the anchors are raised by a winch.

An alternative embodiment, shown in FIG. 6 has a first vertical support column (31) placed on one side of a horizontal resilient surface (32), usually a trampoline; and a second vertical support column (33) is placed on the opposite side of the horizontal resilient surface (32). On the first vertical support column (31) is slidably mounted a first anchor (34) and on the second vertical support column is slidably mounted a second anchor (35). A first resilient band (36) is attached to the first anchor (34) and is to be connected to the participant, preferably near the participant's center of gravity, as is also a second resilient band (37) attached to the second anchor (35) and to be connected to the participant, preferably near the participant's center of gravity, so that as the participant moves laterally from the center of the horizontal resilient surface (32), the participant is subjected to a lateral restraining force which is proportional to the distance that the participant has moved laterally from the center of the horizontal resilient surface (32).

A cable (38) is connected to the first anchor (34). The cable (38) runs over a first upper pulley (39) and around one or more lower pulleys (40) to a winch (41), which may be either a manual winch or a motorized winch. After being connected to the winch (41), the cable (38) then continues over a second upper pulley (42) and down to the second anchor (35) to which the cable (38) is attached. Thus, when the winch (41) is run in one direction, the first anchor (34) and the second anchor (35) will be raised, creating—through the first resilient band (36) and the second resilient band (37)—a greater vertical restraining force on the participant as the participant approaches an impact with the horizontal resilient surface (32); when the winch (41) is run in the opposite direction, the first anchor (34) and the second anchor (35) will be lowered.

Also, a first exercise grip (43) is attached to the first resilient band (36); and a second exercise grip (44) is attached to the second resilient band (37) so that the participant can pull on the first resilient band (36) and the second resilient band (37) to exercise the participant's upper extremities.

Figure 7:
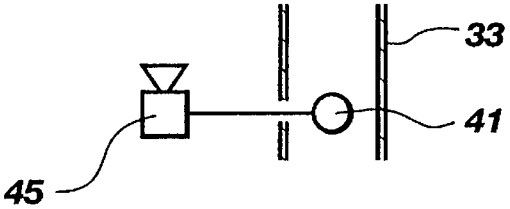
FIG. 7 illustrates the addition of a remote receiver to the embodiment of FIG. 6 so that the anchors can be raised remotely when the winch is motorized.

Finally, as demonstrated in FIG. 7, a remote control receiver (45) may be electrically connected to the winch (41) when the winch (41) is motorized so that the first anchor (34) and the second anchor (35) can be remotely raised and lowered.

Figure 8:
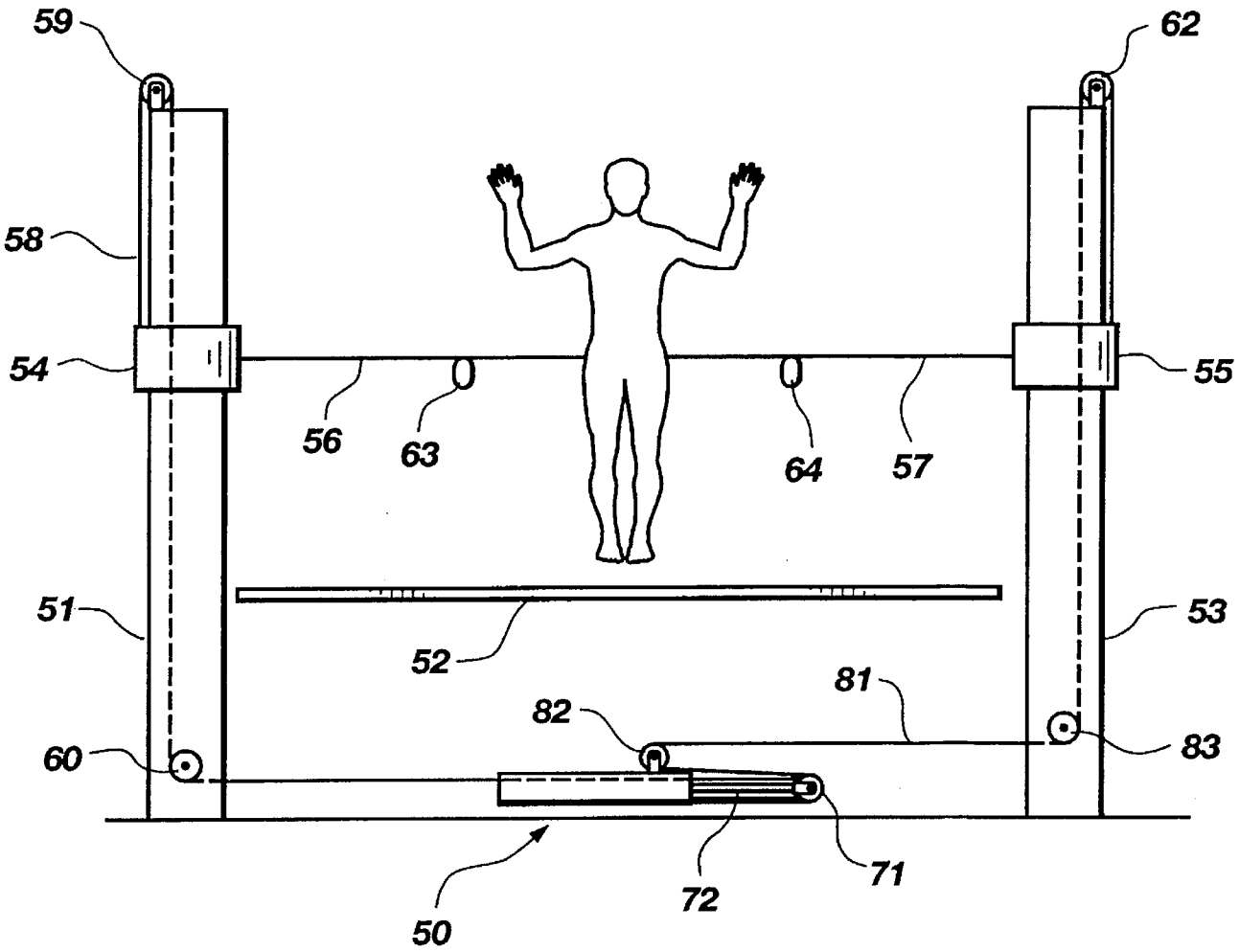
FIG. 8 portrays an embodiment utilizing a hydraulic system to raise the anchors.

A second principal alternative embodiment, shown in FIG. 8, essentially replaces the winch (41) of FIG. 6 with a hydraulic system (50) but, as does the embodiment portrayed in FIG. 1, raises the first anchor (54) and the second anchor (55) in response to the upward bounce of the participant.

This second principal embodiment, consequently, functions much as do the embodiments portrayed in FIG. 1 and FIG. 6.

A first vertical support column (51) is placed on one side of a horizontal resilient surface (52), usually a trampoline; and a second vertical support column (53) is placed on the opposite side of the horizontal resilient surface (52). On the first vertical support column (51) is slidably mounted a first anchor (54), and on the second vertical support column is slidably mounted a second anchor (55). A first resilient band (56) is attached to the first anchor (54) and is to be connected to the participant, preferably near the participant's center of gravity, so that as the participant moves laterally from the center of the horizontal resilient surface (52), the participant is subjected to a lateral restraining force which is proportional to the distance that the participant has moved laterally from the center of the horizontal resilient surface (52).

A first cable (58) is connected to the first anchor (54). The first cable (58) thereafter runs over a first upper pulley (59) and a first lower pulley (60) before passing around an end pulley (71) which is rotatably mounted on the outer end of a rod (72) that extends from the hydraulic system (50); the first cable (58) is then attached to the hydraulic system (50).

Also attached to the hydraulic system (50) is a second cable (81) which proceeds to pass around the end pulley (71), a reverse pulley (82), a second lower pulley (83), and a second upper pulley (62) before connecting to the second anchor (55).

Preferably, a first exercise grip (63) is attached to the first resilient band (56); and a second exercise grip (64) is attached to the second resilient band (57) so that the participant can pull on the first resilient band (56) and the second resilient band (57) to exercise the participant's upper extremities.

Figure 9:
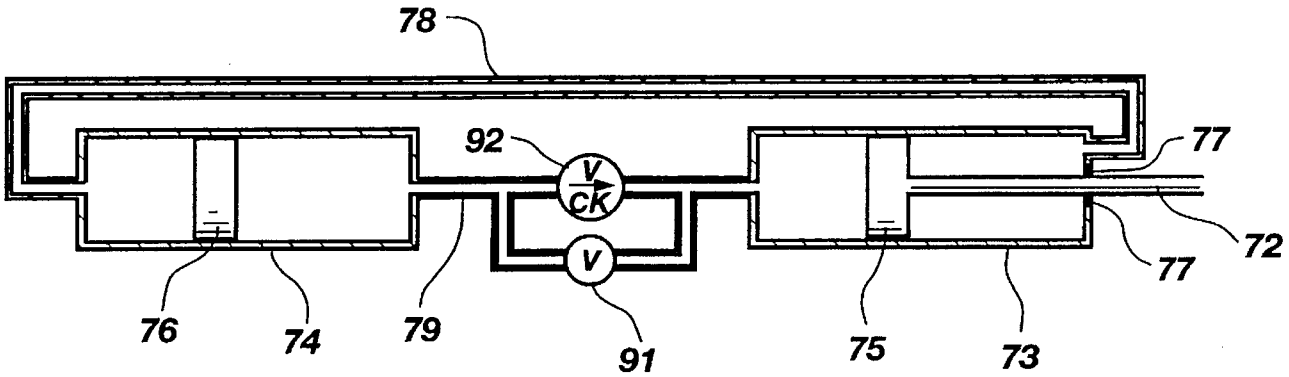
FIG. 9 shows the details of the hydraulic system.

Operation of the hydraulic system (50) can be understood by referring to FIG. 9 in connection with FIG. 8.

The hydraulic system (50) has a first hydraulic cylinder (73) and a second hydraulic cylinder (74). The first hydraulic cylinder (73) contains a first piston (75); and the second hydraulic cylinder (74) contains a second piston (76).

Attached to the first piston (75) is the rod (72) which passes through a seal (77) to extend outward from one end of the first hydraulic cylinder (73). Attached to the end of the first hydraulic cylinder (73) from which the rod (72) extends is a pressure line (78). The other end of the pressure line (78) is connected to one end of the second hydraulic cylinder (74) so that is a fluid—gas or liquid—may be maintained at the same pressure in the pressure line (78) and the portions of the first hydraulic cylinder (73) and the second hydraulic cylinder (74) to which the pressure line (78) is attached.

Connected to the end of the second hydraulic cylinder (74) opposite to the end to which the pressure line (78) is attached is a hydraulic line (79) that divides into two branches before rejoining and connecting to the end of the first hydraulic cylinder (73) opposite to the end to which the pressure line (78) is attached. The hydraulic line (79) and the portions of the first hydraulic cylinder (73) and the second hydraulic cylinder (74) to which the hydraulic line (79) is attached may be filled with hydraulic fluid or oil. Inserted into one branch of the hydraulic line (79) is a valve (91) which may be either open or closed; inserted into the other branch of the hydraulic line (79) is a check valve (92) which may be either open or closed. The check valve (92) allows a fluid to pass through it in only one direction. It is oriented in the hydraulic line (79) so that when the valve (91) is closed, hydraulic fluid can flow only from the second hydraulic cylinder (74) to the first hydraulic cylinder (73).

The cross-sectional area of the first hydraulic cylinder (73) is identical to that of the second hydraulic cylinder (74). The force exerted on the second piston (76) is, therefore, equal to the pressure maintained in the pressure line (78) multiplied by this common cross-sectional area; the force exerted on the first piston (75) is equal to the sum of (i) the pressure maintained in the pressure line (78) multiplied by the difference between the common cross-sectional area and the cross-sectional area of the rod (72) and (ii) atmospheric pressure multiplied by the cross-sectional area of the rod (72). Hence, when the check valve (92) is open, the first piston (75) will be pushed toward the end of the first hydraulic cylinder (73) from which the rod (72) extends, thereby extending the rod (72) farther from the first hydraulic cylinder (73), if the pressure maintained in the pressure line (78) exceeds atmospheric pressure; the first piston (75) will be pushed toward the end of the first hydraulic cylinder (73) to which the hydraulic line (79) is attached if the pressure maintained in the pressure line (78) is less than atmospheric pressure.

FIG. 8 is designed to work with the preferred version of the hydraulic system (50), i.e., the hydraulic system (50) when the pressure maintained in the pressure line (78) exceeds atmospheric pressure.

When the participant is ready to start bouncing, valve (91) is closed and check valve (92) is opened. Before the participant bounces, the participant's weight exerts a downward force on the first resilient band (56) and the second resilient band (57), which transfer this downward force to the first anchor (54) and the second anchor (55), respectively. Through the first cable (58), the first upper pulley (59), the first lower pulley (60), and the end pulley (71), the downward force from the first anchor (54) becomes a force that tends to push the rod (72) into the first hydraulic cylinder (73). Through the second cable (81), the second upper pulley (62), the second lower pulley (83), the reverse pulley (82), and the end pulley (71), the downward force from the second anchor (55) similarly becomes a force that tends to push the rod (72) into the first hydraulic cylinder (73).

As the participant bounces upward, the downward forces on the first anchor (54) and the second anchor (55) are decreased or actually become upward forces, thereby decreasing the forces tending to push the rod (72) into the first hydraulic cylinder (73). The pressure maintained in the pressure line (78) is, consequently, selected such that it will overcome the opposing forces from the first anchor (54) and the second anchor (55) and push the rod (72) so that it extends farther from the first hydraulic cylinder (73) only when the participant bounces upward. When the rod (72) extends farther from the first hydraulic cylinder (73), the first cable (58) pulls the first anchor (54) higher; and the second cable (81) pulls the second anchor (55) an equal distance higher. As the participant descends and, therefore, reexerts the full downward forces on the first anchor (54) and the second anchor (55) the first anchor (54) and the second anchor (55) cannot descend because the rod (72) is precluded from being pushed farther into the first hydraulic cylinder (73) by the fact that hydraulic fluid cannot flow from the first hydraulic cylinder (73) to the second hydraulic cylinder (74) either through the check valve (92) or the closed valve (91).

This process will continue progressively until the rod (72) is fully extended from the first hydraulic cylinder (73). If it is desired to preclude the first anchor (54) and the second anchor (55) from rising to the upper limit of their potential travel, it is simply necessary to close the check valve (92) before the rod (72) has been fully extended from the first hydraulic cylinder (73). Hydraulic fluid will thereby be prevented from flowing from the second hydraulic cylinder (74) to the first hydraulic cylinder (73), thus precluding the force differential exerted on the first piston (75) and the second piston (76) from pushing the rod (72) so that it extends farther from the first hydraulic cylinder (73). If it is not desired to have the ability to stop the upward movement of the first anchor (54) and the second anchor (55) at an intermediate point, the check valve (92) need not have the ability to be closed.

When it is desired to lower the first anchor (54) and the second anchor (55), valve (91) is opened. The downward forces exerted on the first anchor (54) and the second anchor (55) by the weight of the participant will then, as explained above, push the rod (72) farther into the first hydraulic cylinder (73), forcing hydraulic fluid from the first hydraulic cylinder (73), through the open valve (91), and into the second hydraulic cylinder (74). If further control over the rate of descent of the participant is desired, a flow regulator could be placed in the hydraulic line (79). It would also be possible to replace the check valve (92), the two branches of the hydraulic line (79), and the valve (91) with a single compound valve.

Figure 10:
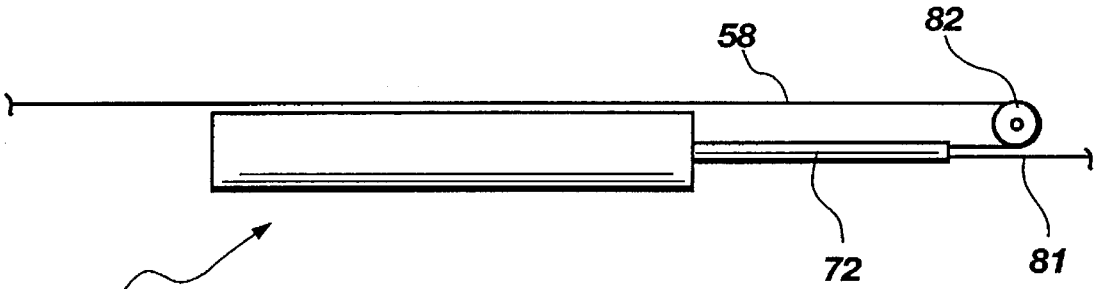
FIG. 10 depicts an alternate embodiment of the hydraulic system.

If it is desired to maintain a pressure in the pressure line (78) that is less than atmospheric pressure, the end pulley (71) would be eliminated, the reverse pulley (82) would be repositioned, and the first cable (58) and the second cable (81) would be connected to the outer end of the rod (72) as portrayed in FIG. 10.

Figure 12:
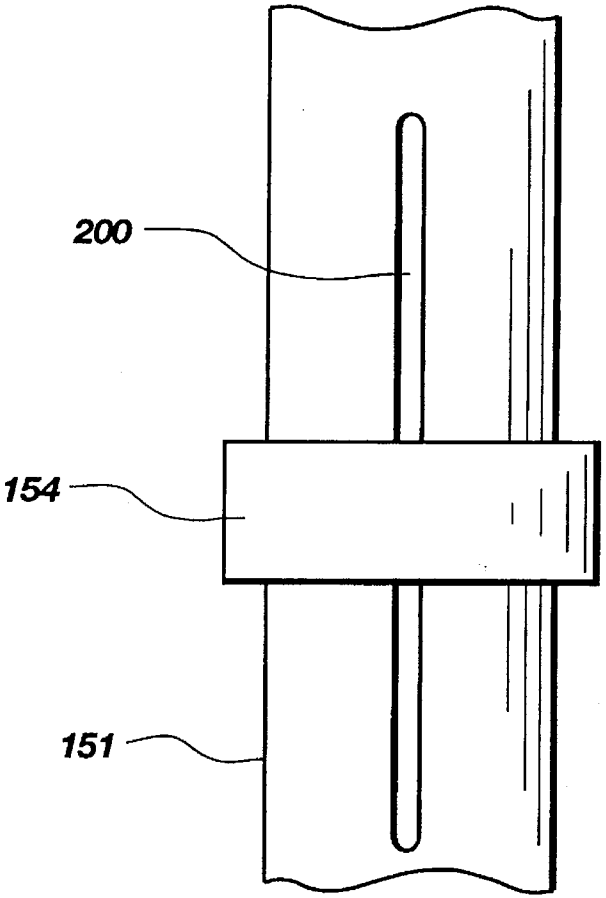
FIG. 12 displays an alternate view of the embodiment shown on FIG. 11.
Figure 11:
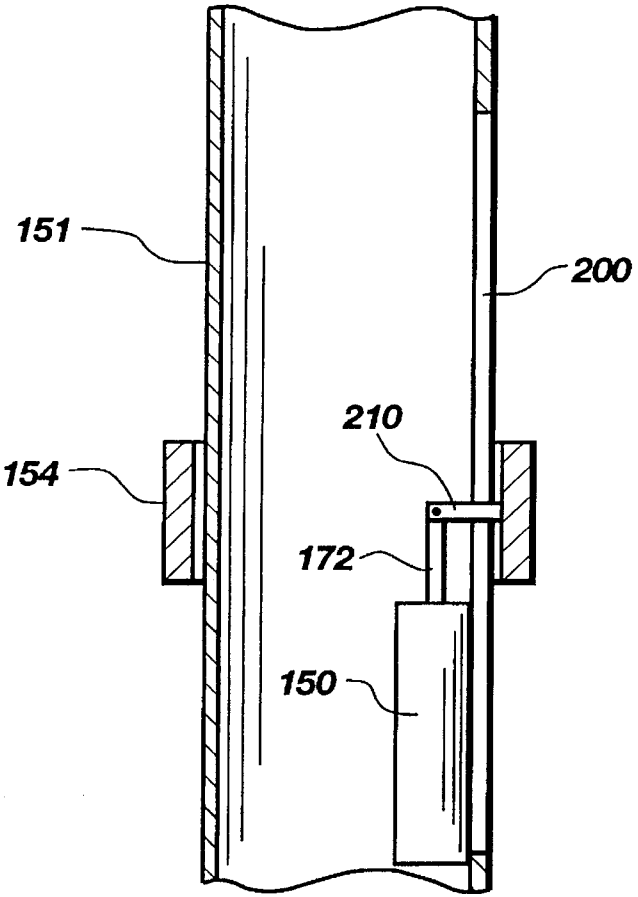
FIG. 11 demonstrates an embodiment of the device for reducing impact and lateral movement on a horizontal resilient surface which utilizes no cables.

It is also possible to eliminate the first cable (58) and the second cable (81) by having the hydraulic system (50) consist of two hydraulic units identical to the unit shown in FIG. 9. This is portrayed in FIG. 11 and FIG. 12 only for the first vertical column (101) since all features in the second vertical column would be symmetrical to those in the first vertical column (101).

The hydraulic system (150) is attached to the inside of the first vertical support column (101). The rod (172) extending from the hydraulic system (150) has connected to it a horizontal member (210), the other end of which passes through a slit (200) contained in the first vertical support column (101) and is attached to the first anchor (154), which—to facilitate illustration—is shown in a cut-away view in FIG. 11. The hydraulic system (150) depicted in FIG. 11 has a pressure greater than atmospheric pressure maintained in the pressure line, shown as (78) in FIG. 9. If the pressure maintained in the pressure line (78) is less than atmospheric pressure, the hydraulic system (150) would simply be oriented in the opposite direction to that depicted in FIG. 11.

Figure 13:
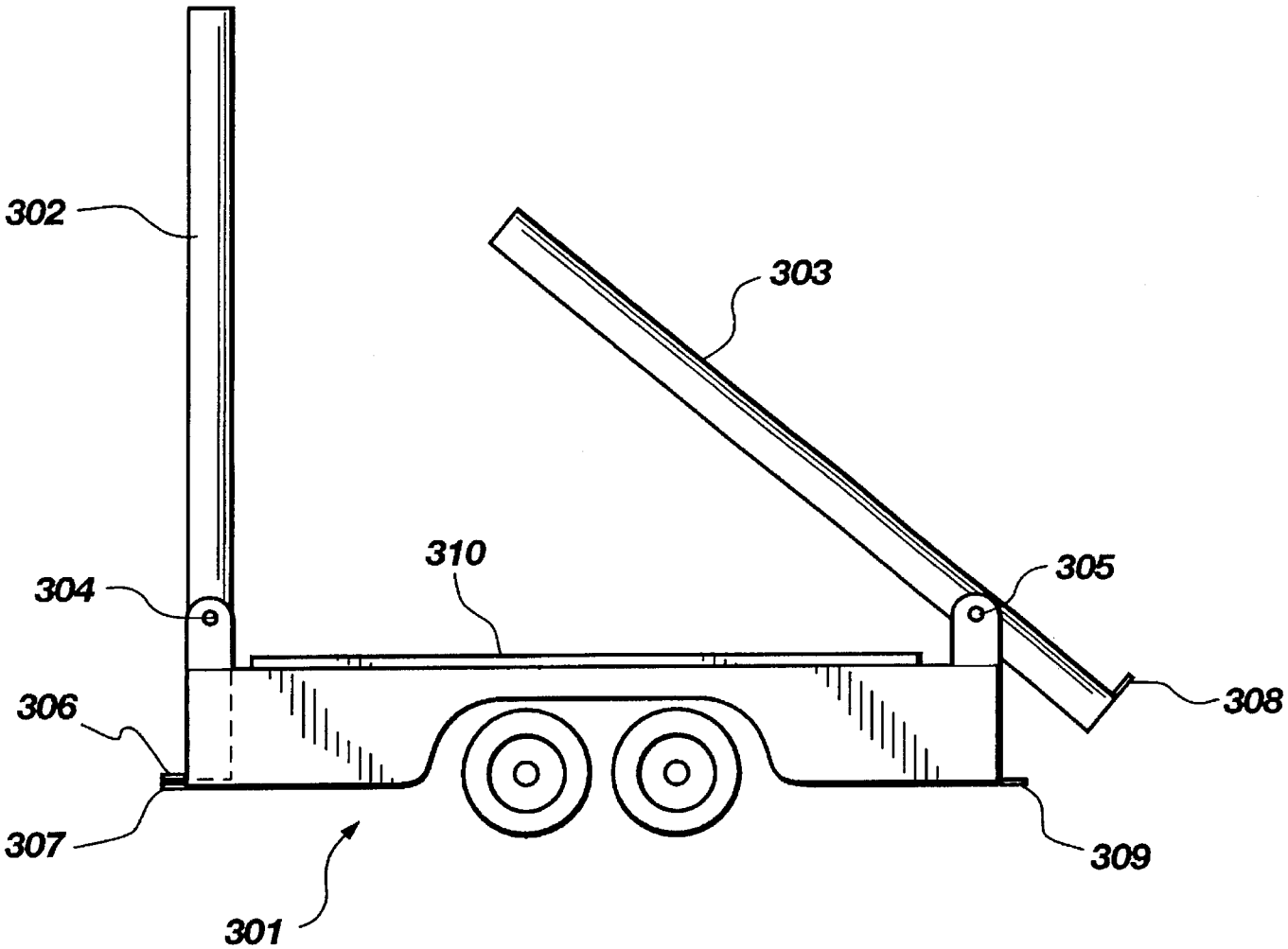
FIG. 13 illustrates the device mounted on a trailer.

Finally, to facilitate mobility, any of the options for the device for reducing impact and lateral movement of a participant on a horizontal resilient surface may be mounted on a trailer (301), as demonstrated in FIG. 13. The first vertical support column (302) and the second vertical support column (303) would be attached to the trailer (301) with a first hinge (304) and a second hinge (305), respectively, so that the first vertical support column (302) and the second vertical support column (303) could be placed in a horizontal position when the trailer (301) is to be moved. The first vertical column (302) contains a locking mechanism to keep it vertical during operation, which is preferably a first horizontal extension (306) having a first hole which aligns with a second hole in a first trailer extension (307) when the first vertical support column (302) is in the vertical position so that a first bolt can be simultaneously placed in the first and second holes. Likewise, the second vertical support column (303) contains a similar locking mechanism, which is preferably a third horizontal extension (308) having a third hole which aligns with a fourth hole in a second trailer extension (309) when the second vertical support column (303) is in the vertical position so that a second bolt can be simultaneously placed in the third and fourth holes.

FIG. 13 also shows the horizontal resilient surface (310), which is attached to the trailer (301).

I claim:

1. A device for reducing impact and lateral movement of a participant on a horizontal resilient surface, which comprises:

a horizontal resilient surface;

a means for exerting a lateral restraining force on the participant which is proportional to the distance that the participant moves laterally from the center of said horizontal resilient surface;

a means for exerting a vertical restraining force on the participant which is proportional to the distance that the participant has moved vertically from said horizontal resilient surface, said vertical restraining means being connected to the lateral restraining means; and a trailer on which are mounted said horizontal resilient surface, the means for exerting a lateral restraining force, and the means for exerting a vertical restraining force.

2. A device for reducing impact and lateral movement of a participant on a horizontal resilient surface, which comprises:

horizontal resilient surface;

a first vertical support column placed on one side of said horizontal resilient surface;

a second vertical support column placed on the opposite side of the horizontal surface from the first vertical support column;

a first anchor slidably mounted on the first vertical support column;

a second anchor slidably mounted on the second vertical support column;

a first resilient band attached to said first anchor and to be connected to the participant;

a second resilient band attached to said second anchor and to be connected to the participant so that the first resilient band and the second resilient band, when attached to the participant, exert upon the participant a lateral restraining force which is proportional to the distance that the participant has moved laterally from the center of said horizontal resilient surface; and a hydraulic system connected to the first anchor and to the second anchor so that the first anchor and the second anchor are raised progressively each time the participant bounces upward, until a desired height is achieved by the first anchor and the second anchor.

* * * * *